US005240296A

United States Patent [19]

Kobayashi

[11] Patent Number: 5,240,296

[45] Date of Patent: Aug. 31, 1993

[54] DOOR LOCK SYSTEM WITH FIRST AND SECOND SENSORS

[75] Inventor: Fumio Kobayashi, Yokohama, Japan

[73] Assignee: Ohi Seisakusho Co., Ltd., Yokohama, Japan

[21] Appl. No.: 854,410

[22] Filed: Mar. 19, 1992

[30] Foreign Application Priority Data

Mar. 29, 1991 [JP] Japan ..... 3-089260

[51] Int. Cl.[5] ..... E05C 3/26

[52] U.S. Cl. ..... 292/201; 292/336.3; 200/61.62

[58] Field of Search ..... 292/336.3, 201; 200/61.62, 61.64

[56] References Cited

U.S. PATENT DOCUMENTS

| | | | |
|---|---|---|---|
| 4,272,112 | 6/1981 | Schlick et al. | 292/201 |
| 4,452,058 | 6/1984 | Noel | 292/201 |
| 4,502,718 | 3/1985 | Sasaki et al. | 292/201 |
| 4,518,181 | 5/1985 | Yamada | 292/201 |
| 4,518,182 | 5/1985 | Cousin et al. | 292/201 |
| 4,569,544 | 2/1986 | Escaravage | 292/201 |
| 4,762,348 | 8/1988 | Matsumoto | 292/201 |
| 4,763,936 | 8/1988 | Rogakos et al. | 292/201 |
| 4,806,712 | 2/1989 | Hoffman et al. | 292/216 |
| 4,850,625 | 7/1989 | Hori et al. | 292/336.3 |
| 4,905,528 | 3/1990 | Kawaguchi et al. | 292/336.3 |
| 5,072,975 | 12/1991 | Hamada et al. | 292/201 |

FOREIGN PATENT DOCUMENTS 55-65681 5/1980 Japan .

*Primary Examiner*—Eric K. Nicholson
*Attorney, Agent, or Firm*—Foley & Lardner

[57] ABSTRACT

A door lock system comprises a door latch device which has a locking-unlocking lever. The door latch device is locked and unlocked when the locking-unlocking lever assumes lock and unlock positions respectively. An electric actuator includes a reversible electric motor and a pivotal operation lever which is actuated by the electric motor. The operation lever is connected to the locking-unlocking lever in such a manner when the operation lever assumes locking and unlocking positions, the locking-unlocking lever assumes the lock and unlock positions respectively. A first device senses a theft protecting operation which causes the operation lever to pivot from the unlocking position to the locking position. A second device locks the operation lever at the locking position when the first device senses the theft protecting operation.

12 Claims, 3 Drawing Sheets

DOOR LOCK SYSTEM WITH FIRST AND SECOND SENSORS

BACKGROUND OF THE INVENTION

1. Field of the Invention

The present invention relates in general to door lock systems for motor vehicles, and more particularly, to automotive door lock systems of a type which comprises a door latch device for latching and unlatching a door, locking means for locking the latched condition of the door latch device, a reversible electric motor for driving the door latch device and a control system for controlling the motor. More specifically, the present invention is concerned with door lock systems of a type having an antitheft means which can protect a lock cancelling operation unjustly applied to the locked door latch device.

2. Description of the Prior Art

One of conventional door lock systems of the above-mentioned antitheft type is disclosed in Japanese Patent First Provisional Publication 55-65681.

The door lock system comprises generally a door latch device with a locking-unlocking lever, a rack member connected with the locking-unlocking lever, a first electric motor for driving the rack member to effect a locking or unlocking operation of the door latch device, a key cylinder switch for sensing an operation of a key cylinder mounted in the door, a lock pawl engageable with the rack member, and a second electric motor for actuating the lock pawl.

When the door is pivoted to its fully closed position, the door latch device latches the door to the vehicle body. When, thereafter, a lock control switch installed in a vehicle cabin is manipulated, the first electric motor is energized to drive the rack member in a direction to achieve a locked condition of the door latch device.

While, when, with the door being latched by door latch device, the key cylinder is manipulated by a key from outside of the vehicle, the door latch device is locked and at the same time, due to operation of the key cylinder switch, the second electric motor is energized to bring the lock pawl into locked engagement with the rack member. With this, the rack member is locked and thus the rack member is suppressed from moving in the lock cancelling direction even when unjustly pushed in such direction by a pick or the like.

However, due to usage of two (viz., first and second) electric motors, construction of the system is complicated and production cost of the same is inevitably increased.

SUMMARY OF THE INVENTION

It is therefore an object of the present invention to provide a door lock system which is simple in construction and can be produced economically.

According to a first aspect of the present invention, there is provided a door lock system which comprises a door latch device having a locking-unlocking lever, the door latch device being locked and unlocked when the locking-unlocking lever assumes lock and unlock positions respectively; an electric actuator including a reversible electric motor and a pivotal operation lever actuated by the electric motor, the operation lever being connected to the locking-unlocking lever in such a manner when the operation lever assumes locking and unlocking positions, the locking-unlocking lever assumes the lock and unlock positions respectively; first sensor means for sensing a given condition wherein the operation lever is in the locking position; second sensor means for sensing a given operation which intends to lock the locking-unlocking lever of the door latch device at the lock position; and locking means for locking the operation lever at the locking position when the first and second sensor means sense the given condition and the given operation respectively.

According to a second aspect of the present invention, there is provided a door lock system which comprises a door latch device having a locking-unlocking lever, the door latch device being locked and unlocked when the locking-unlocking lever assumes lock and unlock positions respectively; an electric actuator including a reversible electric motor and a pivotal operation lever actuated by the electric motor, the operation lever being connected to the locking-unlocking lever in such a manner when the operation lever assumes locking and unlocking positions, the locking-unlocking lever assumes the lock and unlock positions respectively; first means for sensing a predetermined operation which causes the operation lever to pivot from the unlocking position to the locking position; and second means for locking the operation lever at the locking position when the first means senses the predetermined operation.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the door lock system of the present invention will be described in detail with reference to the accompanying drawings.

Figure 1:
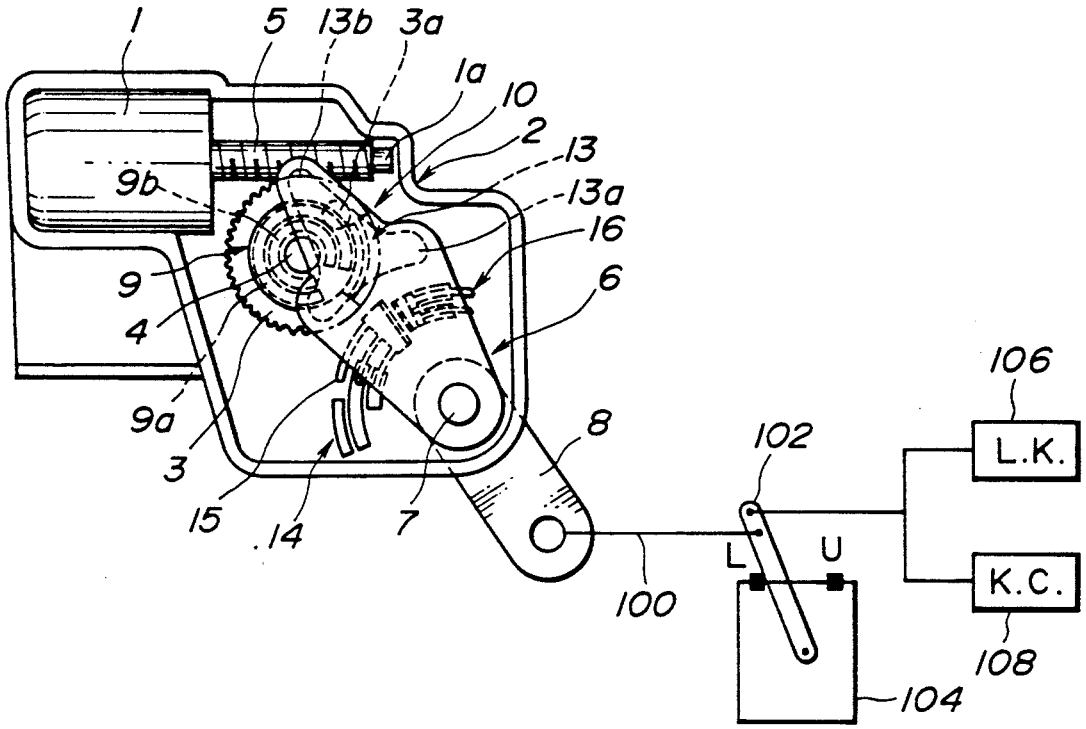
FIG. 1 is a plan view of an essential part of the door lock system according to the present invention, showing a state wherein a theft protecting condition of a door latch device is established.

In the drawings, for example FIG. 1, denoted by numeral 1 is a reversible electric motor installed in a case 2. The motor 1 has a drive shaft 1*a* on which a worm 5 is securely mounted. Operatively engaged with the worm 5 is a worm wheel 3 which is rotatably disposed about a shaft 4 which extends perpendicular to the axis of the drive shaft 1*a*.

Figure 2:
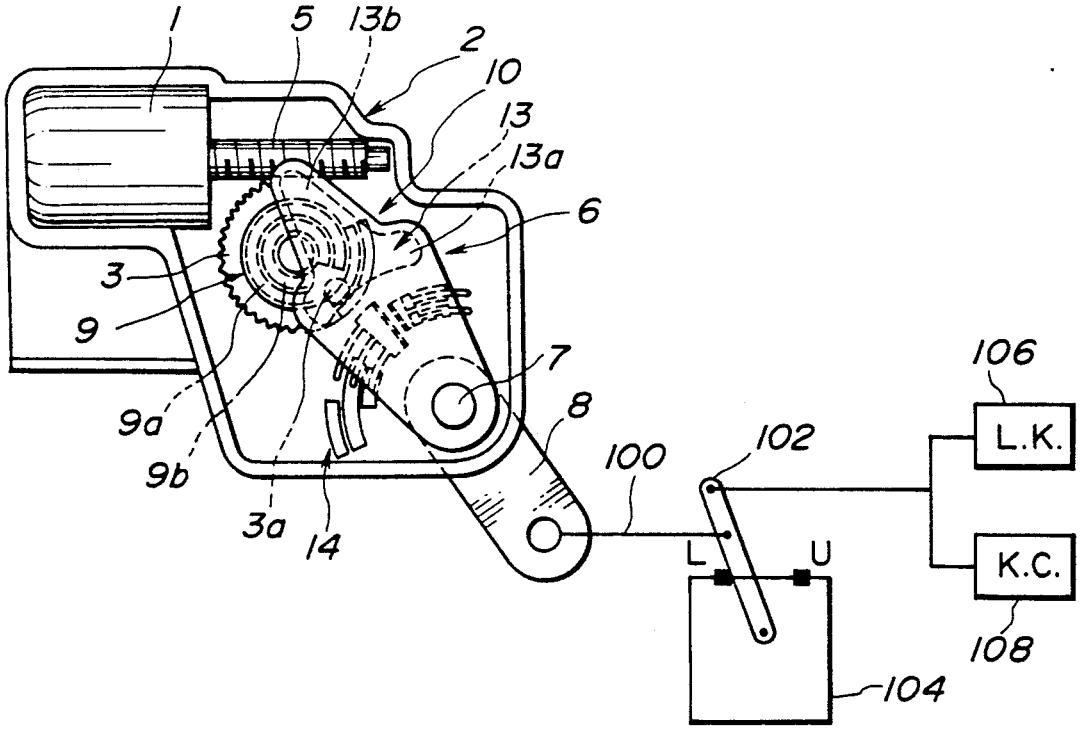
FIG. 2 is a view similar to FIG. 1, but showing a state wherein a locked condition of the door latch device is established.
Figure 3:
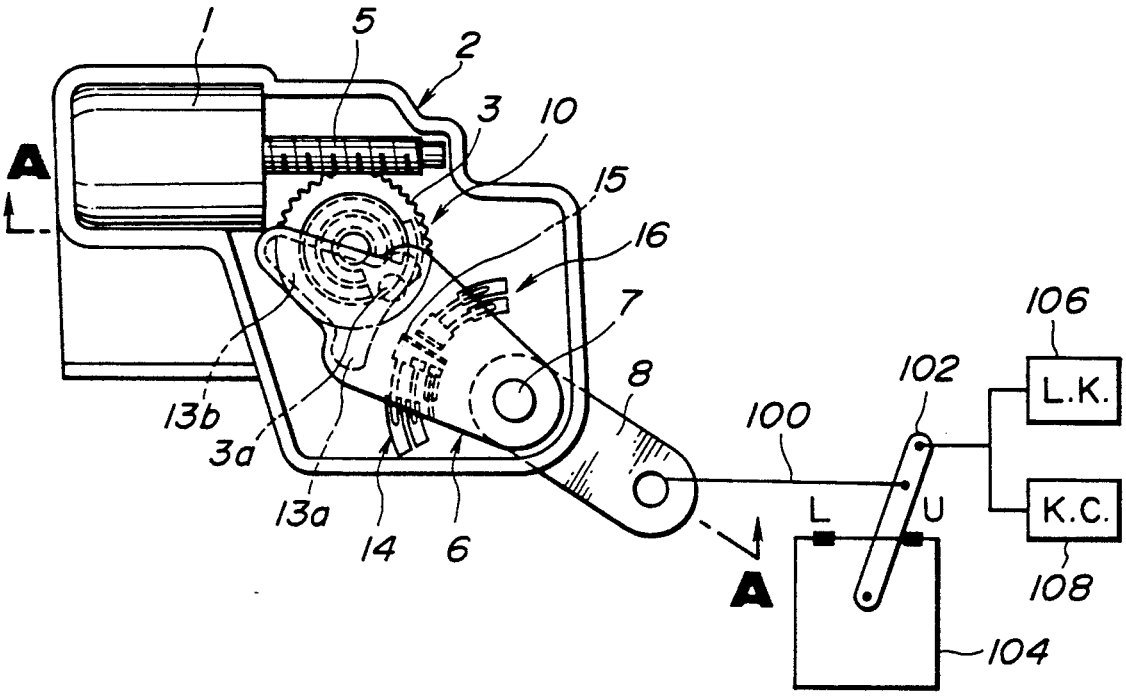
FIG. 3 is a view similar to FIG. 1, but showing a state wherein an unlocked condition of the door latch device is established.

Denoted by numeral 6 is an operation lever which is pivotally connected through a pivot shaft 7 to the case 2. The operation lever 6 is secured to the pivot shaft 7. The operation lever 6 can assume a locking position as shown in FIG. 2 (or FIG. 1) and an unlocking position as shown in FIG. 3.

Denoted by numeral 8 is an output lever which is secured to the pivot shaft 7, so that the output lever 8 and the operation lever 6 pivot together with the pivot shaft 7 like a single unit.

The output lever 8 is connected through a rod 100 to a locking-unlocking lever 102 of a door latch device 104. That is, when the output lever 8 (more specifically, the operation lever 6) assumes the locking position (see FIG. 2), the locking-unlocking lever 102 assumes a lock position wherein a latched condition of the door latch device is locked, and when the output lever 8 is pivoted to the unlocking position (see FIG. 3), the locking-unlocking lever 102 is pivoted to an unlock position wherein the locked condition of the door latch device 104 is cancelled.

It is to be noted that the latched condition of the door latch device 104 means the condition wherein the door latch device establishes a latched engagement of a fully closed door relative to the vehicle body, and the locked condition of the door latch device means the condition wherein the latched condition of the door latch device is locked. Thus, when the door latch device is kept in the latched condition, the door can be opened by only manipulating an outside or inside door handle, while, when the door latch device is kept in the locked condition, the door can not be opened even when the outside or inside door handle is manipulated. The door latch device of this type is disclosed in U.S. Pat. No. 4,850,625 granted to Yasuaki HORI et al on Jul. 25, 1989.

Figure 4:
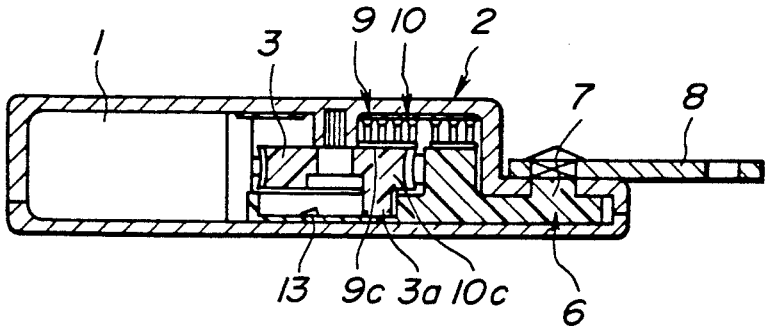
FIG. 4 is a sectional view taken along the line A—A of FIG. 3.

As will be seen from FIG. 4, the worm wheel 3 is formed at one side surface with a projection 3*a* which is slidably engaged with a generally Y-shaped recess 13 formed in one side surface of the operation lever 6.

As will be seen from FIG. 2, the Y-shaped recess 13 substantially consists of an arcuate part 13*a* which is concentric with the pivot shaft 7 and a generally triangular part 13*b* which extends radially outwardly from the arcuate part 13*a*.

As will become apparent hereinafter, the engagement of the projection 3*a* with the recess 13 is so made that when the projection 3*a* on the worm wheel 3 makes one revolution round the axis of the shaft 4, the operation lever 6 is pivoted from the locking position (FIG. 2) to the unlocking position (FIG. 3) and vice versa.

FIG. 2 shows one condition wherein the projection 3*a* assumes its neutral position and engages a left portion of the arcuate part 13*a* causing the operation lever 6 to assume the locking position. When now, due to energization of the electric motor 1, the worm wheel 3 is turned in a counterclockwise direction, the projection 3*a* moves in the recess 13 without having no effect on the operation lever 6 until the same comes to a leading end of the triangular part 13*b*. When the projection 3*a* comes to the leading end, the same abuts against a left wall of the leading end thereby to push downward the operation lever 6 to the unlocking position as shown in FIG. 3. Thereafter, the projection 3*a* moves to its neutral position without having no effect on the operation lever 6 and finally engages a right portion of the arcuate part 13*a*.

Of course, the operation lever 6 in the unlocking position is returned to the locking position when the worm wheel 3 is turned in a reversed direction, that is, in a clockwise direction.

Figure 5:
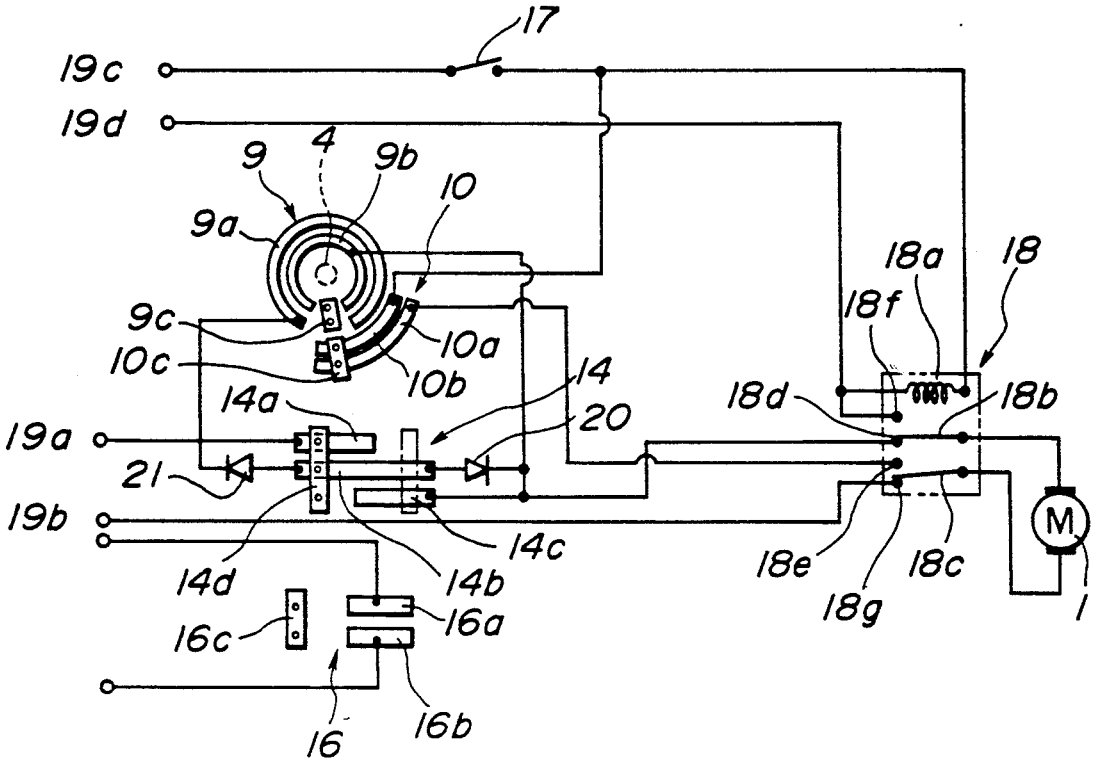
FIG. 5 is a view of a control circuit employed in the door lock system of the invention, showing a state wherein the unlocked condition is established.

Referring to FIG. 5, there is shown a control circuit of the door lock system according to the present invention.

Denoted by numeral 9 in the drawing is a neutral condition detecting switch which comprises first and second semicircular conductive plates 9*a* and 9*b* which are concentric with and spaced from each other. These plates 9*a* and 9*b* have each terminal ends by which a common angled cut zone is defined. The plates 9*a* and 9*b* are mounted to the case 2 in a manner to concentrically surround the shaft 4. Slidably engageable with these two conductive plates 9*a* and 9*b* is a movable contact plate 9*c* which is carried by the worm wheel 3. When the contact plate 9*c* contacts the first and second conductive plates 9*a* and 9*b*, the neutral condition detecting switch 9 assumes ON condition. Under this ON condition, the switch 9 can feed the motor 1 with an electric power, as will become apparent hereinafter.

Denoted by numeral 10 is a theft protection switch which comprises first and second arcuate conductive plates 10*a* and 10*b* which are concentric with and spaced from each other. These plates 10*a* and 10*b* are mounted to the case 2 outside the plates 9*a* and 9*b* in a manner to be concentric with the shaft 4. As is seen from the drawing, the plates 10*a* and 10*b* have portions protruded into an angled zone which is merged with the above-mentioned angled cut zone. Slidably engageable with the first and second arcuate plates 10*a* and 10*b* is a movable contact plate 10*c* which is carried by also the worm wheel 3. When the contact plate 10*c* contacts the plates 10*a* and 10*b*, the theft protection switch 10 assumes ON condition. Under this condition, electric feeding to the motor 1 to run in a reversed direction is permitted as will become apparent hereinafter. That is, when the switch 10 takes ON position, a coil 18*a* of a relay 18 is energized and thus movable contacts 18*b* and 18*c* of the relay 18 are shifted to stationary contacts 18*e* and 18*f*, as will become apparent as the description proceeds.

Denoted by numeral 14 is a position detection device which which can detect the position of the operation lever 6. The switch 14 comprises first, second and third arcuate conductive plates 14*a*, 14*b* and 14*c* which are concentric with and spaced from one another. It is to be noted that for ease of illustration, these arcuate plates 14*a*, 14*b* and 14*c* are illustrated as straight members in FIGS. 5 and 6. As is seen from FIGS. 1 and 2, these plates 14*a*, 14*b* and 14*c* are mounted to the case 2 in a manner to be concentric with the pivot shaft 7 of the operation lever 6. Slidably engageable with these three arcuate conductive plates 14*a*, 14*b* and 14*c* is a movable contact plate 14*d* which is carried by the operation lever 6.

When the operation lever 6 assumes the unlocking position as shown in FIG. 3, the movable contact 14*d* contacts the first and second arcuate conductive plates 14*a* and 14*b* as is seen from FIG. 5. Under this condition, electric feeding to the motor 1 to run in the reversed direction (which causes a clockwise rotation of the worm wheel 3) is permitted upon a locking operation of a lock control switch (not shown) mounted in a vehicle cabin. That is, upon the locking operation of the lock control switch, electric power is fed to the motor 1 from terminals 19*a* and 19*b* of an electric power source (battery) through the movable contacts 18*b* and 18*c* of the relay 18.

Figure 6:
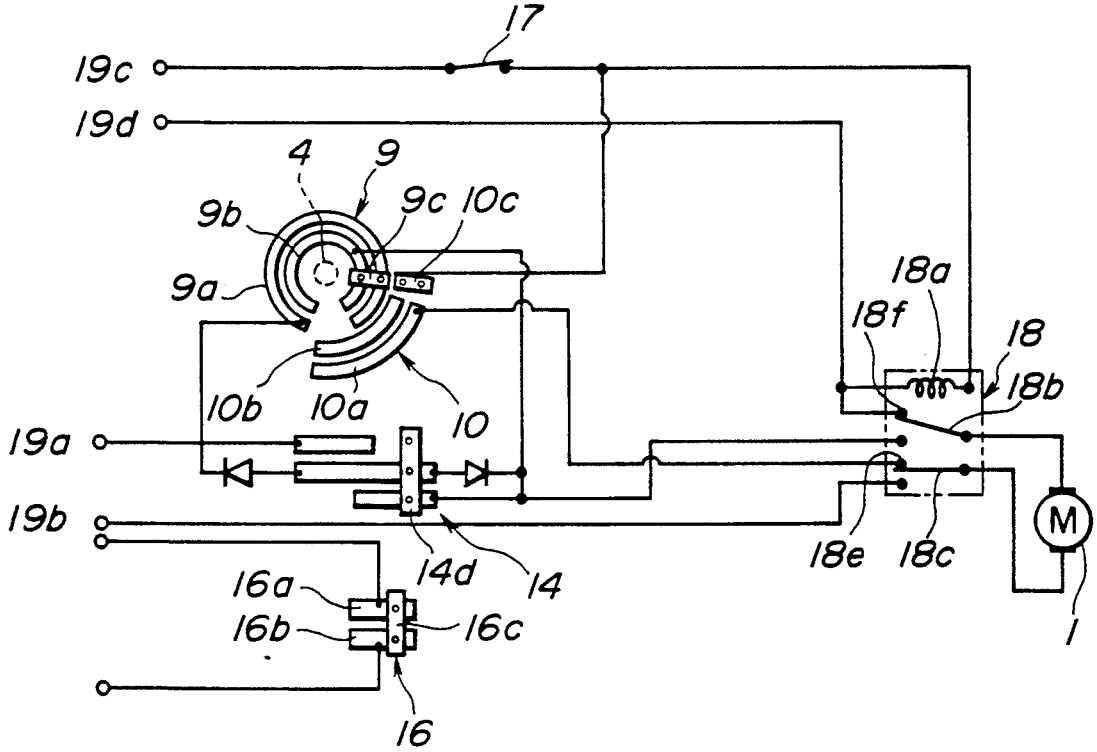
FIG. 6 is a view similar to FIG. 5, but showing a state wherein the theft protecting condition is established.

While, when the operation lever 6 assumes the locking position as shown in FIG. 2, the movable contact 14*d* contacts the second and third arcuate plates 14*b* and 14*c* as is seen from FIG. 6. Under this condition, electric feeding to the motor 1 to run in a normal direction (which causes a counterclockwise rotation of the worm wheel 3) is permitted.

Designated by numeral 16 is a monitor switch which comprises first and second arcuate plates 16*a* and 16*b* which are concentric with and spaced from each other. It is to be noted that for ease of illustration, these two arcuate plates 16*a* and 16*b* are illustrated as straight members in FIGS. 5 and 6. As is seen from FIG. 1, these arcuate plates 16*a* and 16*b* are mounted to the case 2 in a manner to be concentric with the pivot shaft 7 of the operation lever 6. Slidably engageable with the arcuate plates 16*a* and 16*b* is also the operation lever 6. When the operation lever 6 assumes the locking position (see FIG. 2), the monitor switch 16 assumes ON condition. Under this ON condition, a monitor lamp (not shown) installed in the vehicle cabin is energized to light.

Designated by numeral 17 is a key cylinder switch (or theft protection operation detecting switch) which can detect a locking operation of a key cylinder 108 (see FIG. 2) mounted in an outer side of the door. That is, when the key cylinder 108 is turned, by a key, in a direction to achieve the locked condition of the door latch device 104, the switch 17 is turned ON. When the switch 17 is turned ON, a circuit including terminals 19*c* and 19*d* of the electric power source and the coil 18*a* of the relay 18 becomes closed thereby energizing the coil 18*a*. Upon this, the movable contacts 18*b* and 18*c* of the relay 18 are moved to positions as shown in FIG. 6.

In the following, operation of the door lock system of the invention will be described.

For ease of understanding, the description will be commenced with respect to the condition shown in FIG. 2.

Under this condition, the locking-unlocking lever 102 of the door latch device 104 assumes the afore-mentioned lock position. That is, the latched condition of the door latch device 104 is locked. Furthermore, the projection 3*a* of the worm wheel 3 is kept in the neutral position engaging the left portion of the arcuate part 13*a* of the Y-shaped recess 13 of the operation lever 6.

When a lock-knob 106 mounted on an inner side of the door is manipulated in a direction to cancel the locked condition of the door latch device 104, the output lever 8 and thus the operation lever 6 can be pivoted from the locking position as shown in FIG. 2 to the unlocking position as shown in FIG. 3. This is because during the pivoting of the operation lever 6, the projection 3*a* of the suspended worm wheel 3 makes a free movement in the arcuate part 13*a* of the Y-shaped recess 13. Thus, the locked condition of the door latch device 104 assumes the unlocked condition. When such pivoting of the operation lever 6 is completed, the projection 3*a* engages the right portion of the arcuate part 13*a* as shown in FIG. 3.

When thereafter the lock-knob 106 is manipulated in the other direction to achieve the locked condition of the door latch device 104, the operation lever 6 is returned to the locking position (FIG. 2). During this, the projection 3*a* of the suspended worm wheel 3 makes a reversed but free movement in the arcuate part 13*a* of the Y-shaped recess 13.

Thus, the locking and unlocking operation of the lock-knob is smoothly achieved without being interrupted by the projection 3*a* of the suspended worm wheel 3.

The above-mentioned free pivoting of the operation lever 6 is also carried out in response to operation of the key cylinder 108 mounted in the outer side of the door.

That is, when, with the operation lever 6 assuming the locking position as shown in FIG. 2, the key cylinder 108 is turned, by a key, in the direction to cancel the locked condition of the door latch device 104, the operation lever 6 is smoothly pivoted to the unlocking position (FIG. 3), while, when, with the operation lever 6 assuming the unlocking position as shown in FIG. 3, the key cylinder 108 is turned in the other direction to lock the door latch device 104, the operation lever 6 is pivoted to the locking position (FIG. 2).

When, with the operation lever 6 assuming the locking position of FIG. 2, the lock control switch is manipulated in order to cancel the locked condition of the door latch device 104, the electric motor 1 (see FIG. 5) is energized to run in the normal direction. This is because under the locking condition of FIG. 2, the movable contact plate 14*d* of the position detection switch 14 contacts the second and third arcuate conductive plates 14*b* and 14*c* and thus a circuit for running the motor 1 in the normal direction, which includes a diode 20, is closed. With the running of the motor 1 in such normal direction, the worm wheel 3 is turned in a counterclockwise direction in FIG. 2.

As has been described hereinafore, the counterclockwise rotation of the worm wheel 3 causes the operation lever 6 to pivot from the locking position as shown in FIG. 2 to the unlocking position as shown in FIG. 3. Thus, the locked condition of the door latch device 104 is cancelled through the locking-unlocking lever 102.

It is to be noted that, due to the aforementioned reason, the pivoting of the operation lever 6 to the unlocking position is completed prior to completion of one turning of the worm wheel 3.

When the operation lever 6 comes to the unlocking position in the above-mentioned manner, the movable contact plate 14*d* of the position detection switch 14 is disengaged from the third arcuate conductive plate 14*c* (see FIG. 5). Thus, the circuit for running the motor 1 in the normal direction, which includes the diode 20, is opened. However, even when the operation lever 6 is brought to the unlocking position, the movable contact plate 9*c* of the neutral condition detecting switch 9 is still kept in contact with the first and second semicircular conductive plates 9*a* and 9*b*, and thus, a circuit including the neutral condition detecting switch 9 is kept closed thereby permitting continuous running of the motor 1 in the normal direction.

When the projection 3*a* of the worm wheel 3 finally comes to the neutral position as shown in FIG. 3, the movable contact plate 9*c* of the neutral condition detecting switch 9 is disengaged from the first and second semicircular conductive plates 9*a* and 9*b*. Due to the disengagement of the movable contact plate 9*c* from the plates 9*a* and 9*b*, the circuit for running the motor 1 in the normal direction, which includes the neutral condition detecting switch 9, becomes opened and thus the motor 1 stops. Thus, the worm wheel 3 stops at the neutral position as shown in FIG. 3.

When, with the operation lever 6 assuming the unlocking position of FIG. 3, the lock control switch in the vehicle cabin is manipulated in order to lock the door latch device 104, the electric motor 1 is energized to run in the reversed direction. That is, under the unlocking condition of FIG. 3, the movable contact plate 14*d* of the position detection switch 14 contacts the first and second arcuate conductive plates 14*a* and 14*b* and thus a circuit for running the motor 1 in the reversed direction, which includes the a diode 21, is closed as is seen from FIG. 5. With the running of the motor 1 in such reversed direction, the worm wheel 3 is turned in a clockwise direction in FIG. 3.

As has been described hereinafore, the clockwise rotation of the worm wheel 3 causes the operation lever 6 to pivot from the unlocking position as shown in FIG. 3 to the locking position as shown in FIG. 2. Thus, the door latch device 104 is locked through the locking-unlocking lever 102.

Due to the afore-mentioned reason, the pivoting of the operation lever 6 to the locking position is completed prior to completion of one turning of the worm wheel 3.

When the operation lever 6 is pivoted to the locking position in the above-mentioned manner, the movable contact plate 14*d* of the position detection switch 14 is disengaged from the first arcuate conductive plate 14*a*. Thus, the circuit for running the motor 1 in the reversed direction, which includes the diode 21, becomes opened. However, even when the operation lever 6 is pivoted to the locking position, the movable contact plate 9*c* of the neutral condition detecting switch 9 is kept in contact with the first and second semicircular conductive plates 9*a* and 9*b*, and thus, the reversed rotation of the motor 1 is continued.

When now the projection 3*a* of the worm wheel 3 comes to the neutral position as shown in FIG. 2, the movable contact plate 9*c* of the neutral condition detecting switch 9 is disengaged from the first and second semicircular conductive plates 9*a* and 9*b*. Due to the disengagement of the movable contact plate 9*c* from the plates 9*a* and 9*b*, the circuit for running the motor 1 in the reversed direction, which includes the neutral condition detecting switch 9, becomes opened and thus the motor 1 stops. Thus, the worm wheel 3 stops at the neutral position as shown-in FIG. 2.

In the following, operation for achieving the theft protection will be described.

When, with the operation lever 6 assuming the unlocking position of FIG. 3, the key cylinder 108 mounted in the outer side of the door is turned, by a key, in a direction to achieve the locked condition of the door latch device 104, the operation lever 6 is forced to pivot from the unlocking position to the locking position (FIG. 2) and at the same time the theft protection operation detecting switch 17 is turned ON. With this, the coil 18*a* of the relay 18 is energized thereby to shift the movable contacts 18*b* and 18*c* to the stationary contacts 18*e* and 18*f*. Thus, a circuit including theft protection operation detecting switch 17, the theft protection switch 10, the relay 18, the motor 1 and the power source terminals 19*c* and 19*d* is closed thereby energizing the motor 1 to run in the normal direction. Due to the running of the motor 1, the worm wheel 3 is turned in a counterclockwise direction from the neutral position of FIG. 2.

When, due to the counterclockwise rotation of the worm wheel 3, the projection 3*a* on the same comes to a right wall of the triangular part 13*b* of the Y-shaped recess 13, the movable contact plate 10*c* of the theft protection switch 10 is disengaged from the first and second arcuate conductive plates 10*a* and 10*b*.

With this, a circuit including the switch 10 is opened and thus the motor 1 stops. Thus, the worm wheel 3 stops at a theft protection position as shown in FIG. 1 wherein the projection 3*a* engages the right wall of the triangular part 13*b* of the Y-shaped recess 13.

As will be understood from FIG. 1, when the worm wheel 3 is in such theft protection position, the operation lever 6 is locked at the locking position due to the blocking work carried out by the projection 3*a*. This means that even when the operation lever 6 is unjustly pushed toward the unlocking position by a car theft handling a pick or the like, the lever 6 can not be moved to such unlocking position. Thus, very reliable antitheft function can be possessed by the door lock system of the invention.

What is claimed is:

1. A door lock system comprising:

a door latch device having a locking-unlocking lever, said door latch device being locked and unlocked when said locking-unlocking lever assumes lock and unlock positions respectively;

an electric actuator including a reversible electric motor and a pivotal operation lever actuated by said electric motor, said operation lever being connected to said locking-unlocking lever in such a manner that when said operation lever assumes locking and unlocking positions, said locking-unlocking lever assumes said lock and unlock positions respectively;

first sensor means for sensing a given condition wherein said operation lever is in said locking position;

second sensor means for sensing a given operation which intends to lock said locking-unlocking lever of said door latch device at said lock position; and locking means for locking said operation lever at said locking position when said first and second sensor means sense at the same time said given condition and said given operation respectively.

2. A door lock system comprising:

a door latch device having a locking-unlocking lever, said door latch device being locked and unlocked when said locking-unlocking lever assumes lock and unlock positions respectively;

an electric actuator including a reversible electric motor and a pivotal operation lever actuated by said electric motor, said operation lever being connected to said locking-unlocking lever in such a manner that when said operation lever assumes locking and unlocking positions, said locking-unlocking lever assumes said lock and unlock positions respectively;

first means for sensing a predetermined operation which causes said operation lever to pivot from said unlocking position to said locking position; and second means for locking said operation lever at said locking position when said first means senses said predetermined operation.

3. A door lock system as claimed in claim 2, in which said second means comprises:

a wheel driven by said electric motor to rotate about its axis;

a projection formed on said wheel to rotate therewith; and means for defining in said operation lever a recess with which said projection is slidably engageable.

4. A door lock system as claimed in claim 3, in which said recess of the operation lever is so shaped and constructed that when said wheel makes one revolution about its wheel, said operation lever is forced to pivot between said locking and unlocking positions.

5. A door lock system comprising:

a door latch device having a locking-unlocking lever, said door latch device being locked and unlocked when said locking-unlocking lever assumes lock and unlock positions respectively;

an electric actuator including a reversible electric motor and a pivotal operation lever actuated by said electric motor, said operation lever being connected to said locking-unlocking lever in such a manner that when said operation lever assumes locking and unlocking positions, said locking-unlocking lever assumes said lock and unlock positions respectively;

first means for sensing a predetermined operation which causes said operation lever to pivot from said unlocking position to said locking position; and second means for locking said operation lever at said locking position when said first means senses predetermined operation, said second means comprising:

a wheel driven by said electric motor to rotate about its axis;

a projection formed on said wheel to rotate therewith; and a recess defined in said operation lever with which said projection is slidably engageable;

said recess being generally Y-shaped and constructed that when said wheel makes one revolution about its wheel, said operation lever is forced to pivot between said locking and unlocking positions, said recess comprising an arcuate part concentric with an axis about which said operation lever pivots, and a generally triangular part extending radially outwardly from said arcuate part.

6. A door lock system as claimed in claim 5, in which the slidable engagement of said projection with said Y-shaped recess is so made that when said projection assumes a predetermined neutral position, said operation lever assumes either one of said locking and unlocking positions.

7. A door lock system as claimed in claim 6, in which the slidable engagement of said projection with said Y-shaped recess is so made that when said operation lever is locked at the locking position, said projection of said wheel engages one wall of the triangular part of said recess.

8. A door lock system comprising:

a door latch device having a locking-unlocking lever, said door latch device being locked and unlocked when said locking-unlocking lever assumes lock and unlock positions respectively;

an electric actuator including a reversible electric motor and a pivotal operation lever actuated by said electric motor, said operation lever being connected to said locking-unlocking lever in such a manner that when said operation lever assumes locking and unlocking positions, said locking-unlocking lever assumes said lock and unlock positions respectively;

first means for sensing a predetermined operation which causes said operation lever to pivot from said unlocking to said locking position;

second means for locking said operation lever at said locking position when said first means senses said predetermined operation, said second means comprising a wheel driven by said electric motor to rotate about its axis, a projection formed on said wheel to rotate therewith and means for defining in said operation lever a recess with which said projection is slidably engageable;

a neutral condition detecting switch which detects the state wherein said operation lever is in said neutral position, said neutral condition detecting switch being capable of energizing said electric motor when assuming ON position;

a theft protection switch which is capable of energizing said electric motor even when said neutral condition detecting switch assumes OFF position; and a position detection switch which can detect the position of said operation lever; and a relay which can change the direction of flow of electricity fed to said electric motor in accordance with the position which said position detection switch detects.

9. A door lock system as claimed in claim 8, in which said neutral condition detecting switch comprises:

first and second semicircular conductive plates which are concentric with and spaced from each other, said first and second plates being secured a fixed structure in a manner to be concentric with the axis of said wheel, said first and second semicircular plates having each terminal ends by which a common angled cut zone is defined; and a movable contact plate carried by said pivotal operation lever and slidably engaged with said first and second semicircular conductive plates.

10. A door lock system as claimed in claim 9, in which said theft protection switch comprises:

first and second arcuate conductive plates which are concentric with and spaced from each other, said first and second arcuate conductive plates being secured to said fixed structure in a manner to be concentric with the axis of said wheel, said first and second arcuate plates having portions protruded into an angled zone which is merged with said angled cut zone of said first and second semicircular conductive plates; and a movable contact plate carried by said wheel and slidable engaged with said first and second semicircular conductive plates.

11. A door lock system as claimed in claim 10, in which said position detection switch comprises:

first, second and third arcuate conductive plates which are concentric with and spaced from one another, said first, second and third arcuate conductive plates being secured to said fixed structure in a manner to be concentric with an axis about which said operation lever pivots; and a movable contact plate carried by said operation lever and slidably engaged with said first, second and third arcuate conductive plates.

12. A door lock system as claimed in claim 2, in which said first means comprises a theft protection operation detecting switch which detects a locking operation of a key cylinder mounted in an outer side of the door.

* * * * *